US009223243B2

(12) United States Patent
Sone et al.

(10) Patent No.: US 9,223,243 B2
(45) Date of Patent: Dec. 29, 2015

(54) CHARGING DEVICE AND IMAGE FORMING APPARATUS INCLUDING THE SAME

(71) Applicant: Konica Minolta, Inc., Tokyo (JP)

(72) Inventors: Shintaro Sone, Yokohama (JP); Hiroyuki Saito, Tokyo (JP); Hisayoshi Nagase, Hachioji (JP); Kazuteru Ishizuka, Saitami (JP); Tatsuya Furuta, Tokyo (JP); Kazutoshi Kobayashi, Hachioji (JP)

(73) Assignee: KONICA MINOLTA, INC. (JP)

( * ) Notice: Subject to any disclaimer, the term of this patent is extended or adjusted under 35 U.S.C. 154(b) by 0 days.

(21) Appl. No.: 13/900,154

(22) Filed: May 22, 2013

(65) Prior Publication Data

US 2013/0315615 A1 Nov. 28, 2013

(30) Foreign Application Priority Data

May 24, 2012 (JP) ..... 2012-118249

(51) Int. Cl.
*G03G 15/02* (2006.01)

(52) U.S. Cl.
CPC ..... *G03G 15/0258* (2013.01); *G03G 15/0291* (2013.01); *G03G 2215/027* (2013.01)

(58) Field of Classification Search
CPC . G03G 15/02; G03G 15/0225; G03G 15/025; G03G 15/0258
USPC ..... 399/100
See application file for complete search history.

(56) References Cited

U.S. PATENT DOCUMENTS

2009/0060535 A1* 3/2009 Hamaya ..... 399/34
2010/0278553 A1* 11/2010 Burry et al. ..... 399/100

FOREIGN PATENT DOCUMENTS

| | | | |
|---|---|---|---|
| JP | 52-55537 | A | 5/1977 |
| JP | 52-55538 | A | 5/1977 |
| JP | 59-228679 | A | 12/1984 |
| JP | S6129059 | A | 2/1986 |
| JP | 61-219059 | A | 9/1986 |
| JP | 8-220846 | A | 8/1996 |
| JP | 09311589 | A | 12/1997 |
| JP | 2001-166546 | A | 6/2001 |
| JP | 2003-280337 | A | 10/2003 |
| JP | 2004-325535 | A | 11/2004 |
| JP | 2005-92117 | A | 4/2005 |
| JP | 2006-126660 | A | 5/2006 |
| JP | 2007279305 | A | 10/2007 |
| JP | 2009-25521 | A | 2/2009 |

OTHER PUBLICATIONS

Machine translation of Yamaguchi, JP 2005092117 A, publication date: Apr. 7, 2005.*

(Continued)

*Primary Examiner* — Walter L Lindsay, Jr.
*Assistant Examiner* — Frederick Wenderoth
(74) *Attorney, Agent, or Firm* — Cantor Colburn LLP

(57) ABSTRACT

A charging device has a charging member to charge an object, an applying unit to apply a voltage to the charging member for generating an electric discharge from the charging member, so that the object is discharged by the charging member, a detecting unit to detect an emission of light of the electric discharge, an output unit to output a detection result by the detecting unit, a cleaning unit to clean the charging member, and a controller to control the cleaning unit to clean the charging member when the detection result is out of a predetermined range.

3 Claims, 11 Drawing Sheets

(56) References Cited

OTHER PUBLICATIONS

Machine translation of Kishi, JP JP 02048691 A, publication date: Feb. 19, 1990.*

Japanese Notification of Reasons for Refusal corresponding to Application No. 2012-118249; Date of Mailing: Feb. 24, 2015, with English translation.

Japanese Office Action "Notice of Reasons for Refusal" regarding Patent Application No. 2012-118249; Mailing Date: Jul. 22, 2014.

* cited by examiner

CHARGING DEVICE AND IMAGE FORMING APPARATUS INCLUDING THE SAME

CROSS-REFERENCE TO RELATED APPLICATION

This application is based on Japanese Patent Application No. 2012-118249 filed with Japan Patent Office on May 24, 2012, the entire content of which is hereby incorporated by reference.

TECHNICAL FIELD

The present invention relates to a charging device that applies a voltage to a charging member, allows the charging member to cause a discharge, and thereby charges a charging target, and to an image forming apparatus including the same.

DESCRIPTION OF RELATED ART

There has been widely known an image forming apparatus, which uses an electrophotographic method of charging an image carrier by a charging device, exposing the charged image carrier by light corresponding to an image by using an exposure device, thereby forming an electrostatic latent image, visualizing the above-described electrostatic latent image by toner by using a developing device, transferring a toner image thus visualized to a transfer material, fixing the toner image transferred onto the transfer material, and thereby forming an image.

The charging device, which is provided in the image forming apparatus using the above-described electrophotographic method, is required to uniformly charge a surface of the image carrier. When unevenness occurs in a charged state of the surface of the image carrier, the unevenness concerned in the charged state appears as image unevenness, and accordingly, image quality is lowered.

In Japanese Patent Laid-Open Publication No. 2009-25521, as the charging device that charges the surface of the image carrier, there is disclosed a noncontact-type charging device, which applies a voltage to a wire-like charging member, allows the charging member to cause a discharge, and thereby charges the surface of the image carrier.

In the above-described charging device, when dirt such as toner and dust adheres onto the charging member, an abnormal discharge sometimes occurs. When the abnormal discharge occurs, it becomes impossible to uniformly charge the image carrier, and there has been an apprehension that the image unevenness may appear.

In Japanese Patent Laid-Open Publication No. 2009-25521, there is described a cleaning device, which, in the above-described noncontact-type charging device, controls a wire cleaning unit to clean the charging member for each image formation of the number of sheets, which is inputted by a user.

On the other hand, in Japanese Patent Laid-Open Publication No. H08-220846, there is described a contact-type charging device which charges the image carrier by bringing a charging roller into contact therewith, wherein the charging device detects an amount of toner that has adhered onto the charging roller, and controls operations of cleaning means for cleaning the charging roller in response to the detected amount of toner.

In accordance with the charging device including the cleaning device described in Japanese Patent Laid-Open Publication No. 2009-25521, the charging member is cleaned for each image formation of such a predetermined number of the sheets. However, in the case where the dirt of the charging member is much, then sometimes, there has occurred such an event that the dirt cannot be removed from the charging member completely even if the cleaning is performed therefor, resulting in continuation of the image formation while the dirt is being left on the charging member. In this case, there has been a problem that the image unevenness appears since the abnormal discharge occurs and the image carrier is not uniformly charged.

In the above-described noncontact-type charging device, if there is employed such a technology for controlling the operations of the cleaning means in response to the amount of toner that has adhered to the charging member, the technology being described in Japanese Patent Laid-Open Publication No. H08-220846, then wasteful cleaning can be prevented and sudden dirt of the charging member can be coped with rather than in the case of performing the cleaning for each predetermined number of the sheets as described in Japanese Patent Laid-Open Publication No. 2009-25521.

However, even if the cleaning means is configured to be controlled in response to a degree of the dirt of the charging member as described above, the image unevenness caused by the fact that the surface of the image carrier is nonuniformly charged has sometimes occurred.

That is to say, even if it is sensed that the dirt of the charging members is a little, the current case is sometimes such a case where the abnormal discharge occurs in actual. In this case, the charging unevenness occurs, and accordingly, the image unevenness occurs unless the charging member is cleaned.

SUMMARY

In general, in one aspect, the present invention relates to an image forming apparatus wherein an image is formed on a sheet. The image forming apparatus comprises a charging device comprising: a charging member to charge an object; an applying unit to apply a voltage to the charging member for generating an electric discharge from the charging member, so that the object is discharged by the charging member; a detecting unit to detect an emission of light of the electric discharge; an output unit to output a detection result by the detecting unit; a cleaning unit to clean the charging member; and a controller to control the cleaning unit to clean the charging member when the detection result is out of a predetermined range.

Preferably, the controller notifies that the charging member should be exchanged when the detection result exceeds a predetermined threshold.

Preferably, the controller controls the charging device to stop the charging operation of the object when the detection result is out of the predetermined range.

Preferably, the output unit outputs a voltage value as the result of the detection.

Preferably, the detecting unit comprises: a receptor to receive the emission of light; and a condensing member to condense the emission of light on the receptor.

Preferably, the detecting unit is moved integrally with the cleaning unit.

Preferably, the detecting unit and the cleaning unit is moved independently of each other.

DETAILED DESCRIPTION OF THE PREFERRED EMBODIMENTS

Figure 1:
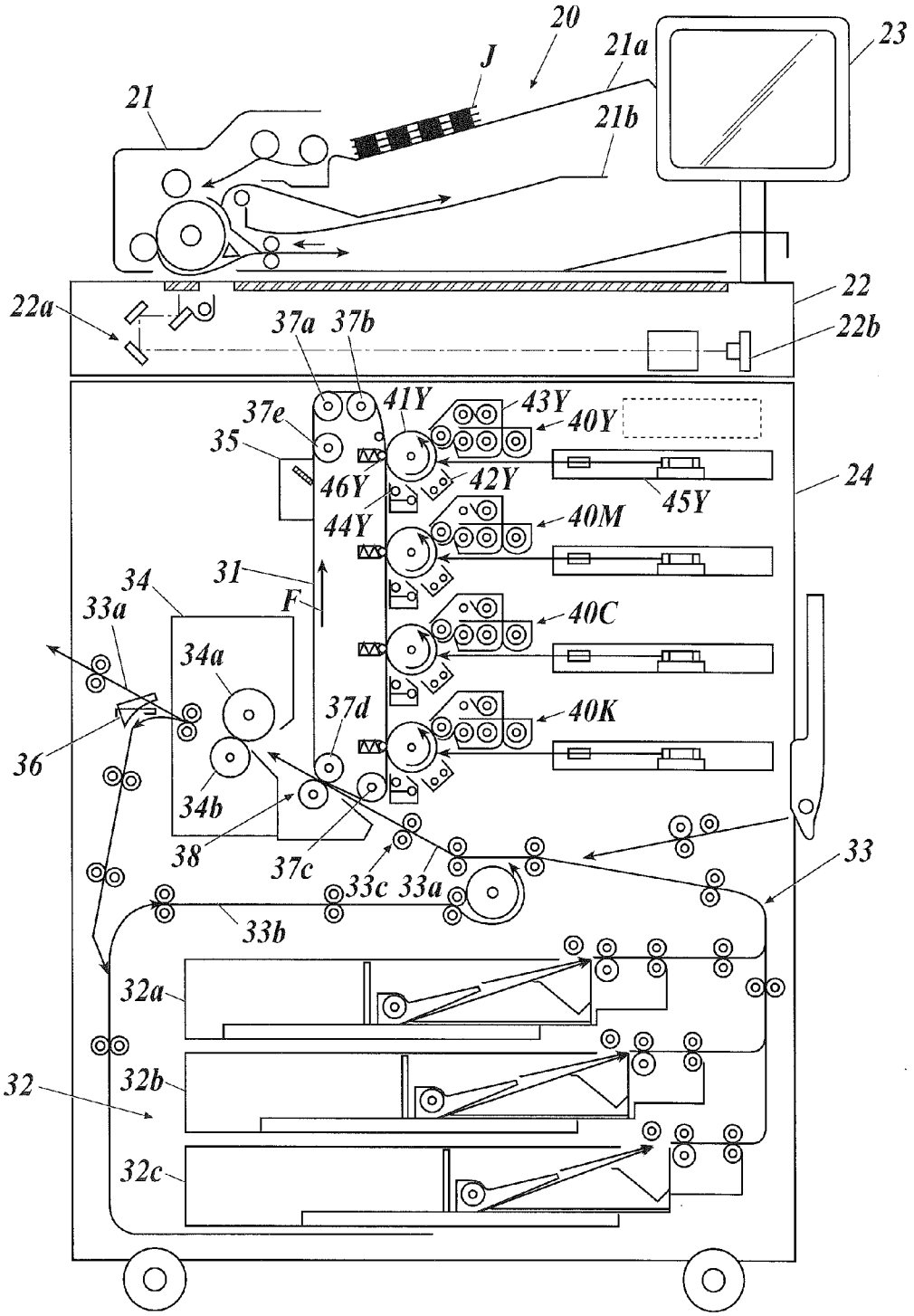
FIG. 1 is a cross-sectional view showing a configuration of a whole of an image forming apparatus.

A description is made below of a first embodiment of the present invention while referring to the drawings. FIG. 1 is a cross-sectional view showing a configuration of a whole of an image forming apparatus including a charging device in this embodiment.

An image forming apparatus 20 is an image forming apparatus capable of forming a color image on a transfer material (a recording sheet), the image forming apparatus being called a tandem-type image forming apparatus. The image forming apparatus 20 includes: a scanner unit 22; a printer unit 24; a sheet feed unit 32; an operation display unit 23; and the like. Note that, though the description is made below by using an image forming apparatus capable of forming a color image, the present invention is also applicable to an image forming apparatus capable of forming only a monochrome image.

The scanner unit 22 includes: an automatic original feeding device 21; an optical system 22*a*; a CCD image sensor 22*b*; and the like.

The printer unit 24 includes: image forming units 40Y, 40M, 40C, 40K which form toner images corresponding to the respective colors of yellow, magenta, cyan and black; an intermediate transfer belt 31 as an image carrier onto which the toner images formed by the respective image forming units are to be transferred; a secondary transfer unit 38 as a transferring unit that transfers the toner images on the intermediate transfer belt 31 onto sheets; a fixing device 34 that fixes the toner images transferred onto the sheets; and the like.

The sheet feed unit 32 includes: sheet feed trays 32*a* to 32*c*; and the like. Appropriate sheets are fed at appropriate timing by the sheet feed unit 32.

The operation display unit 23 includes, for example, a touch panel-type screen (a monitor), and a user touches icons and the like, which are to be displayed on the screen, and can thereby perform setting regarding contents of image formation, instruction to start the image formation, and the like.

The above is a summary of the respective units of the image forming apparatus 20. Subsequently, while taking as an example the case of forming a color image on each of the sheets by the image forming apparatus 20, a description is made of a series of operations for such formation of the color image.

When the instruction to start the image formation is made on the operation display unit 23, an original J mounted on an original stage 21*a* of the automatic original feeding device 21 is conveyed to an original reader. Then, reflected light of light irradiated onto the original from a light source (not shown) is read by the CCD image sensor 22*b* through the optical system 22*a*.

Various pieces of image processing are implemented for an image signal, which is read by the CCD image sensor 22*b*, by an image processing unit (an image processor) to be described later. Then, based on the image signal subjected to the image processing, the image forming units 40Y to 40K form the toner images of the respective colors.

The image forming unit 40Y that forms the toner image of the yellow color includes: a photosensitive drum 41Y as an image carrier, a charging unit (a charging device) 42Y, an exposure unit 45Y, a developing unit 43Y, and a cleaning unit 44Y. In the case of forming the image, the photosensitive drum 41Y is rotated in a direction of an arrow E in FIG. 1 by a drive unit (not shown), and a surface thereof is uniformly charged by the charging unit 42Y. Based on the above-described image signal, the exposure unit 45Y irradiates a laser beam onto the photosensitive drum 41Y thus uniformly charged, whereby an electrostatic latent image corresponding to the image of the yellow color is formed.

Next, the electrostatic latent image on the photosensitive drum 41Y is developed by the developing unit 43Y, and the toner image of the yellow color is formed on the photosensitive drum 41Y. The formed toner image is electrostatically transferred onto the intermediate transfer belt 31 by applying a transfer voltage to a primary transfer roller 46Y. The toner that remains on the surface of the photosensitive drum 41Y without being completely transferred onto the intermediate transfer belt 31 is removed by the cleaning unit 44Y.

All of the image forming unit 40M that forms the toner image of the magenta color, the image forming unit 40C that forms the image of the cyan color, and the image forming unit 40K that forms the image of the black color have a similar configuration to that of the image forming unit 40Y that forms the image of the yellow color, and accordingly, a detailed description thereof is omitted.

The intermediate transfer belt 31 is an endless belt wound around rollers 37*a* to 37*e*, and is rotatably supported. As the intermediate transfer belt 31, a belt made of resin represented by polyimide and a belt in which an elastic layer is provided on a resin raw material are used in general. In the event of performing the image formation, the intermediate transfer belt 31 is rotationally moved in a direction of an arrow F in FIG. 1 by rotational drive of the drive roller 37*a*.

In the event of performing color image formation, the transfer voltage is applied to the primary transfer rollers corresponding to the respective colors, whereby, sequentially from the toner image of the yellow color, the toner images of the respective colors are individually transferred electrostatically onto the intermediate transfer belt 31 at timing when the toner images are superimposed on one another.

Meanwhile, the sheets fed by any of the sheet feed trays 32*a* to 32*c* are conveyed though a conveying path 33*a*, and reach a resist roller pair 33*c*. Conveying-direction skew of the sheets is corrected in such a manner that the sheets are thrust against a nip portion of the resist roller pair 33*c*. Then, each of the sheets is conveyed to the secondary transfer unit 38 in matching with timing when the color toner images on the intermediate transfer belt 31 are moved to a position opposite to the secondary transfer unit 38.

In the secondary transfer unit 38 as the transferring unit, the color toner images on the intermediate transfer belt 31 are electrostatically transferred onto the sheet (the recording sheet). The sheet onto which the color toner images are transferred is conveyed toward the fixing device (a fixing unit) 34, and the toner images are fixed. Meanwhile, the toner that remains on the intermediate transfer belt 31 without being completely transferred onto the sheet in the secondary transfer unit 38 is removed by an intermediate transfer belt cleaning unit 35.

The fixing device 34 includes: a fixing roller 34*a*; a pressurizing roller 34*b*; and the like. A heating unit is provided in the fixing roller 34*a*. Heat and pressure are applied to the sheet by the fixing roller 34*a* and the pressurizing roller 34*b*, whereby the toner images are fixed.

The sheet onto which the toner images are fixed is conveyed through the conveying path 33*a*, and is discharged to an outside of the image forming apparatus 20.

In the case of forming images on both surfaces of the sheet, the sheet in which the toner images are fixed to the surface by the fixing device 34 is conveyed toward a reversing route 33*b* by a branch unit 36, and a rearmost end thereof in the conveying direction is reversed. The sheet in which the rearmost end is reversed passes through the reversing route 33*b*, and is conveyed to the resist roller pair 33*c*, where the conveying-direction skew thereof is corrected.

Thereafter, color toner images corresponding to an image to be formed on a back surface of the sheet is transferred in the secondary transfer unit 38 as mentioned above, the color toner images on the back surface are fixed by the fixing device 34, and the sheet is discharged to the outside of the image forming apparatus 20.

Figure 2A:
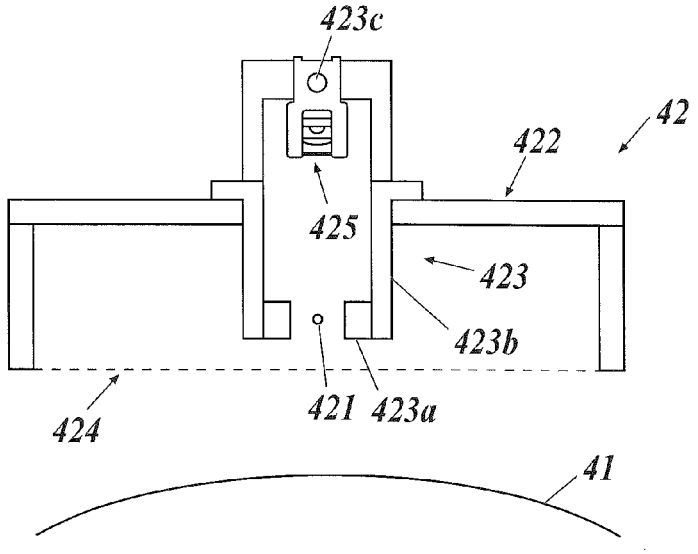
FIGS. 2A, 2B and 2C are cross-sectional views showing a configuration of a charging unit.

The above is the description of a series of the operations in the event of forming the color image on the sheet by the image forming apparatus 20. Next, a description is made of a configuration of the charging unit 42. FIG. 2A is a cross-sectional view showing the configuration of the charging unit 42. The charging unit 42 is a unit provided in each of the image forming units 40Y to 40K which form the toner images of the above-mentioned respective colors.

Figure 2B:
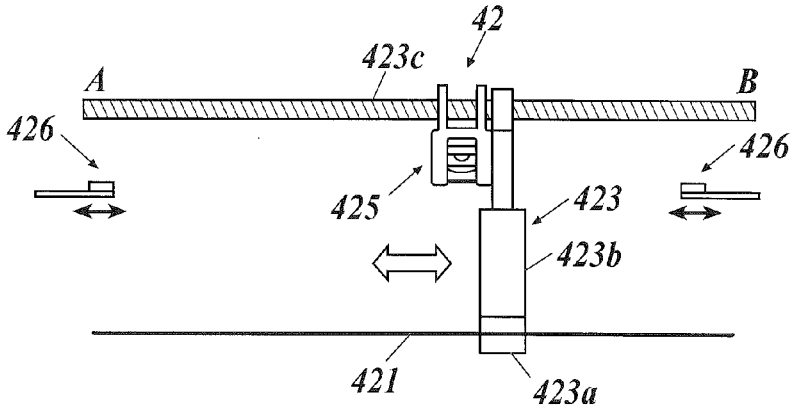
Figure 2C:
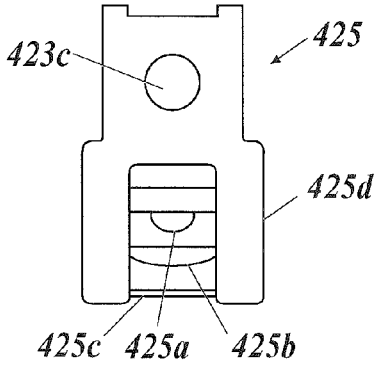

For the charging unit 42, a corotron-type or scorotron-type charging device is used. FIGS. 2A to 2C show the scorotron-type charging device.

As shown in FIGS. 2A and 2B, the charging unit 42 includes: a charging wire 421 as a charging member; a stabilizer (a board) 422; a cleaning unit 423; a grid 424; a photosensor unit 425; and the like.

A power supply (an applying unit, not shown) is connected to the charging wire 421, and a high voltage is applied thereto when an instruction for the charging is made. When the high voltage is applied to the charging wire 421, a corona discharge is generated, and a surface of the photosensitive drum 41 is charged. The charging wire 421 is made of, for example, tungsten, a wire diameter thereof is 30 μm, and a surface thereof is subjected to gold plating.

The stabilizer 422 is composed of a conductive member, and is arranged so as to surround the charging wire 421. Moreover, a direction of the stabilizer 422 toward the photosensitive drum 41 is opened in order to charge the photosensitive drum 41.

The cleaning unit 423 includes: a cleaning member 423*a*; a holding member 423*b*; and a guide rail 423*c*. As the cleaning member 423*a*, a member in which abrasive particles are coated on nonwoven fabric is used. In the case of cleaning the charging wire 421, the holding member 423*b* is moved in a direction of the charging wire 421 by a locking mechanism (not shown), and the cleaning member 423*a* is turned to a state of being brought into contact with the charging wire 421. This state is defined as a locked state. A voltage is not configured to be applied to the charging wire 421 at the time of the locked state.

When the cleaning unit 423 turns to the locked state, then by drive of a drive unit (a moving unit, not shown), the cleaning unit 323 moves between points A and B of FIG. 2B along the guide rail 423*c*, whereby the charging wire 421 is physically cleaned by the cleaning member 423*a*.

FIG. 2C is an enlarged view of the photosensor unit 425 as a detecting unit. The photosensor unit 425 includes: a photosensor 425*a*; a light condensing lens 425*b*; a protection plate 425*c*; a holding member 425*d*; and the like.

For the photosensor 425*a*, a GaAsP photodiode is used. An emission of light by the corona discharge is an emission of light in the ultraviolet range, and accordingly, an element capable of sensing the emission of light in the ultraviolet range is used as the photosensor 425*a*. Moreover, in order to efficiently sense a discharge emission of light by the photosensor 425*a*, the light condensing lens 425*b* that condenses light to the photosensor 425*a* is provided. Furthermore, the protection plate 425*c* is provided in order to protect the light condensing lens 425*b* from a discharge, toner dirt and the like. The protection plate 425*c* is made of, for example, acrylic resin. The photosensor 425*a*, the light condensing lens 425*b* and the protection plate 425*c* are all held by the holding member 425*d*.

By the drive of the drive unit (not shown), the photosensor unit 425 is moved between the points A and B of FIG. 2B along the guide rail 423*c* integrally with the cleaning unit 423, and senses the discharge emission of light from the charging wire 421 over a length direction thereof.

In the case of sensing the discharge emission of light by the photosensor unit 425, the locked state of the cleaning unit 423 is released, the high voltage is applied to the charging wire 421 to generate the discharge, and then the photosensor unit 425 is moved along the guide rail 423*c*.

When the cleaning unit 423 and the photosensor unit 425 reach the position denoted by reference symbol A or B in the guide rail 423*c*, a surface of the protection plate 425*c* is cleaned by a protection plate cleaning member 426. A plurality of the protection plate cleaning members 426 are individually driven by drive units (not shown). For example, the protection plate cleaning members 426 are reciprocally moved in an arrow direction of FIG. 2B by the drive units (not shown), and thereby clean the surface of the protection plate 425*c* in a rubbing manner.

Figure 3A:
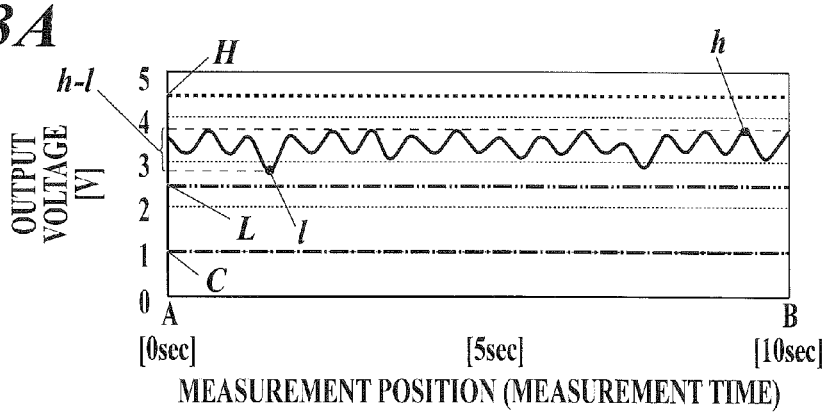
FIGS. 3A, 3B and 3C are views showing examples of sensing results of a discharge emission of light.
Figure 3B:
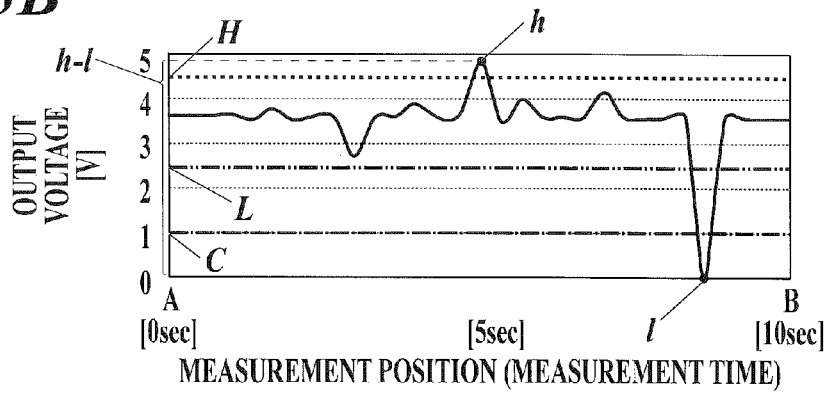
Figure 3C:
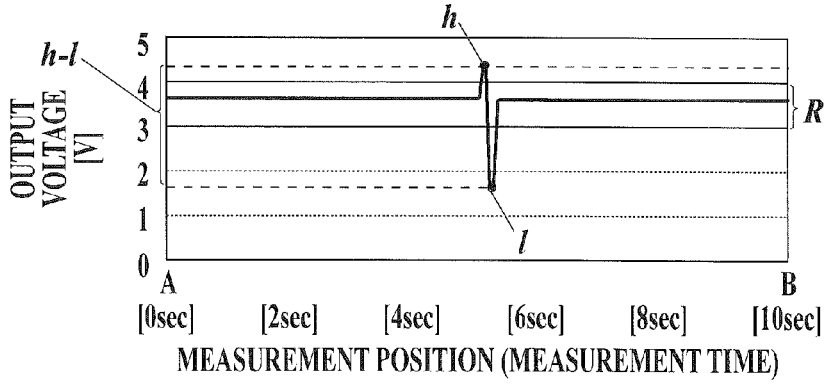

The above is the description of the configuration of the charging unit 42 in this embodiment. In this embodiment, the photodiode is used for the photosensor 425*a* as mentioned above, and sensing results of the emission of light are outputted as voltage values. FIGS. 3A to 3C respectively show examples of the sensing results of the discharge emission of light.

FIGS. 3A to 3C are views individually showing the examples of the sensing results. An axis of abscissas in each graph in FIGS. 3A to 3C indicates a position corresponding to the length direction of the charging wire 421, and an axis of ordinates therein indicates an output voltage. Moreover, the axis of abscissas also corresponds to a moving time of the cleaning unit 423.

In this embodiment, as shown in FIGS. 3A and 3B, an upper limit H and a lower limit L, which serve as a predetermined range, are provided for such output voltages as the sensing results of the discharge emission of light. In the case where the output voltage exceeds the upper limit H or falls down below the lower limit L as in the sensing result shown in FIG. 3B, it is determined that the discharge is in an abnormal state, and the charging wire 421 is cleaned by the cleaning unit 423. The upper limit H and the lower limit L are set as appropriate in response to desired image quality and productivity. That is to say, the user reduces a difference between the upper limit H and the lower limit L, thereby can increase a cleaning frequency of the charging wire 421, and can enhance the image quality preferentially over the productivity. Meanwhile, the user increases the difference between the upper limit H and the lower limit L, thereby can reduce the cleaning frequency of the charging wire 421, and can put priority on the productivity rather than on the image quality.

Moreover, there is provided a wire replacement voltage C, and a notice indicating a time for replacement has come is issued in the case where the output voltage of sensing result lowers the wire replacement voltage C a predetermined number of times. Details of these controls will be described later.

Moreover, in FIGS. 3A and 3B, such a configuration may also be adopted, in which the upper limit H and the lower limit L are not provided, and in the case where a difference h−l between a maximum value h and minimum value l of the output voltage is larger than a predetermined value, the cleaning unit 423 is allowed to clean the charging wire 421. Furthermore, this determination which takes the difference h−l as a reference may be used in combination with the above-mentioned determination which takes the upper limit H and the lower limit L as references.

Moreover, in the case where such a variation h−l is larger than a range R during an extremely short period Δt as shown in FIG. 3C, the cleaning unit 423 may be allowed to clean the charging wire 421. Note that the range R in this case is set narrower than a range defined between the upper limit H and the lower limit L, which are shown in FIGS. 3A and 3B. In the configuration where the photosensor unit 425 senses the discharge emission of light while moving along the charging wire 421, in the case where there are variations on the state of the discharge emission of light, which is sensed during such a short period, it is determined that the charging wire 421 is in an abnormal state in some way even in the case where the variations concerned are somewhat small, and then the charging wire 421 is cleaned. The range R serving as a reference can be set as appropriate.

Moreover, in this embodiment, Δt is set at 0.1 second; however, this can also be set as appropriate. Furthermore, the above-mentioned determination which takes the upper limit H and the lower limit L as references and the above-mentioned determination which takes as a reference the difference between the maximum value and minimum value of the output voltage may be used in combination with each other.

Figure 4:
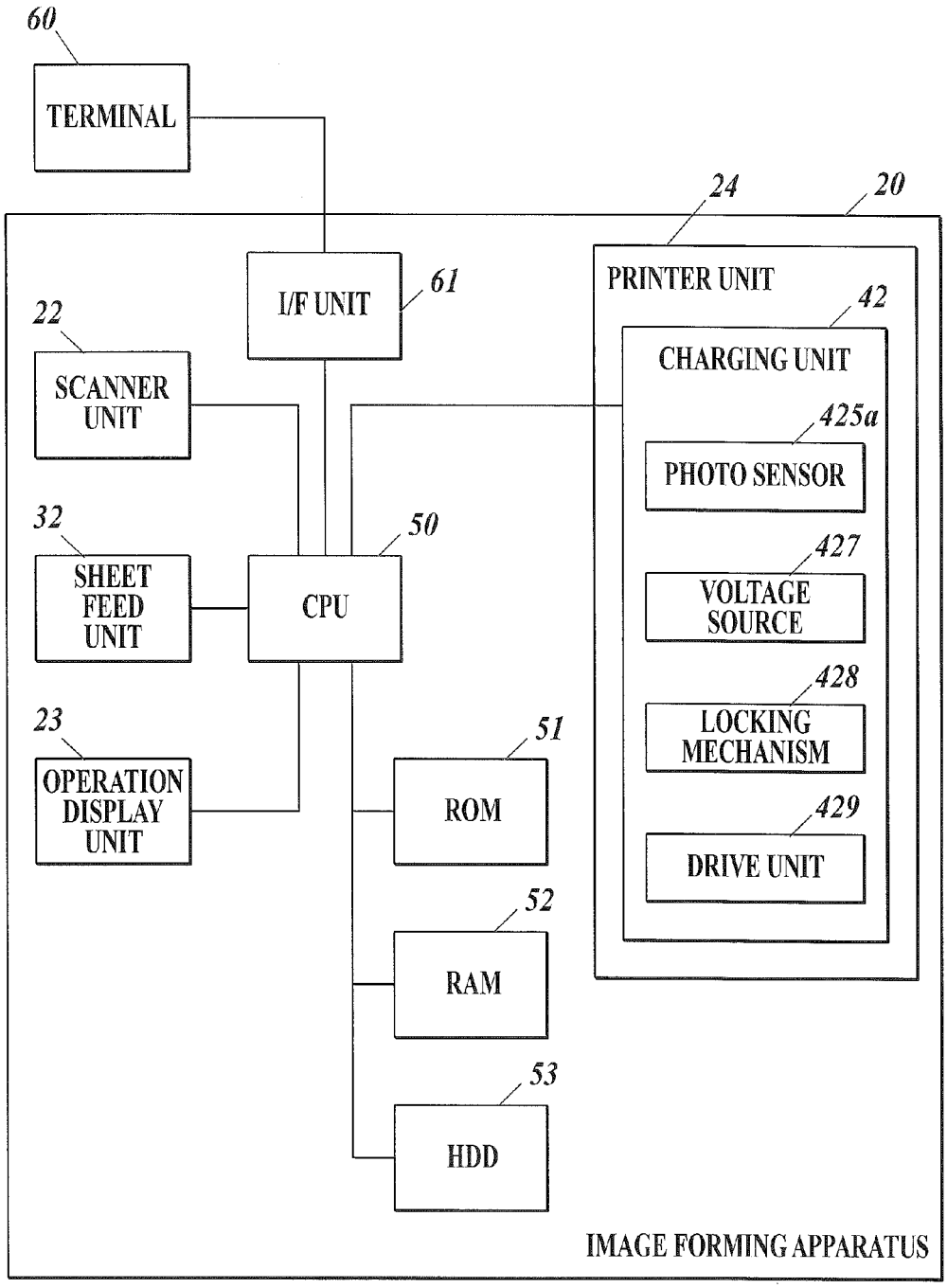
FIG. 4 is a block diagram showing an electric configuration of the whole of the image forming apparatus.

FIG. 4 is a block diagram showing an electric configuration of the whole of the image forming apparatus in this embodiment. The image forming apparatus 20 includes: the scanner unit 22; the printer unit 24; the operation display unit 23; the sheet feed unit 32; a CPU 50; a ROM 51; a RAM 52; an HDD 53; and the like.

The CPU 50 plays a role as a control unit (a controller) that controls the operations of the respective units of the image forming apparatus 20. Based on input contents to be transmitted from the respective units of the image forming apparatus 20, the CPU 50 controls the individual operations of the respective units of the image forming apparatus 20.

In the ROM 51, a variety of programs or data are stored. The CPU 50 reads out the programs or the data from the ROM 51, and controls the respective units of the image forming apparatus 20.

The RAM 52 is a place where the programs or the data, which are necessary in the event where the CPU 50 controls the operations of the above-described respective units, are temporarily stored.

The HDD 53 is a place where image data is stored. Data of the original image read by the scanner unit 22 is stored in the HDD 53.

The charging unit 42 described by using FIG. 2 is included in the printer unit 42. As mentioned above, the charging unit 42 includes: the photosensor 425*a* that senses the discharge emission of light; a voltage source 427 that applies a voltage to the charging wire 421; a locking mechanism 428 that locks the cleaning unit 423 and releases the locked state thereof; and a drive unit (a moving unit) 429 that moves the cleaning unit 423 along the guide rail 423*c*.

Each of the sensing results by the photosensor 425*a* is outputted to the CPU 50, and the CPU 50 performs control, which will be described later, based on the sensing result thus outputted. That is to say, the charging unit 42 plays a role as an output part. Moreover, in accordance with an instruction from the CPU 50, the voltage source (an applying unit) 427, the locking mechanism 428 and the drive unit 429 operate individually.

Moreover, a terminal 60 is network-connected to the image forming apparatus 20 through an I/F unit 61. To the terminal 60, information regarding a job in which the image formation is performed is inputted, and the information concerned is transmitted to the CPU 50 in the image forming apparatus 20. Furthermore, from the terminal 60, it is also possible to issue the instruction to start the image formation.

Figure 5:
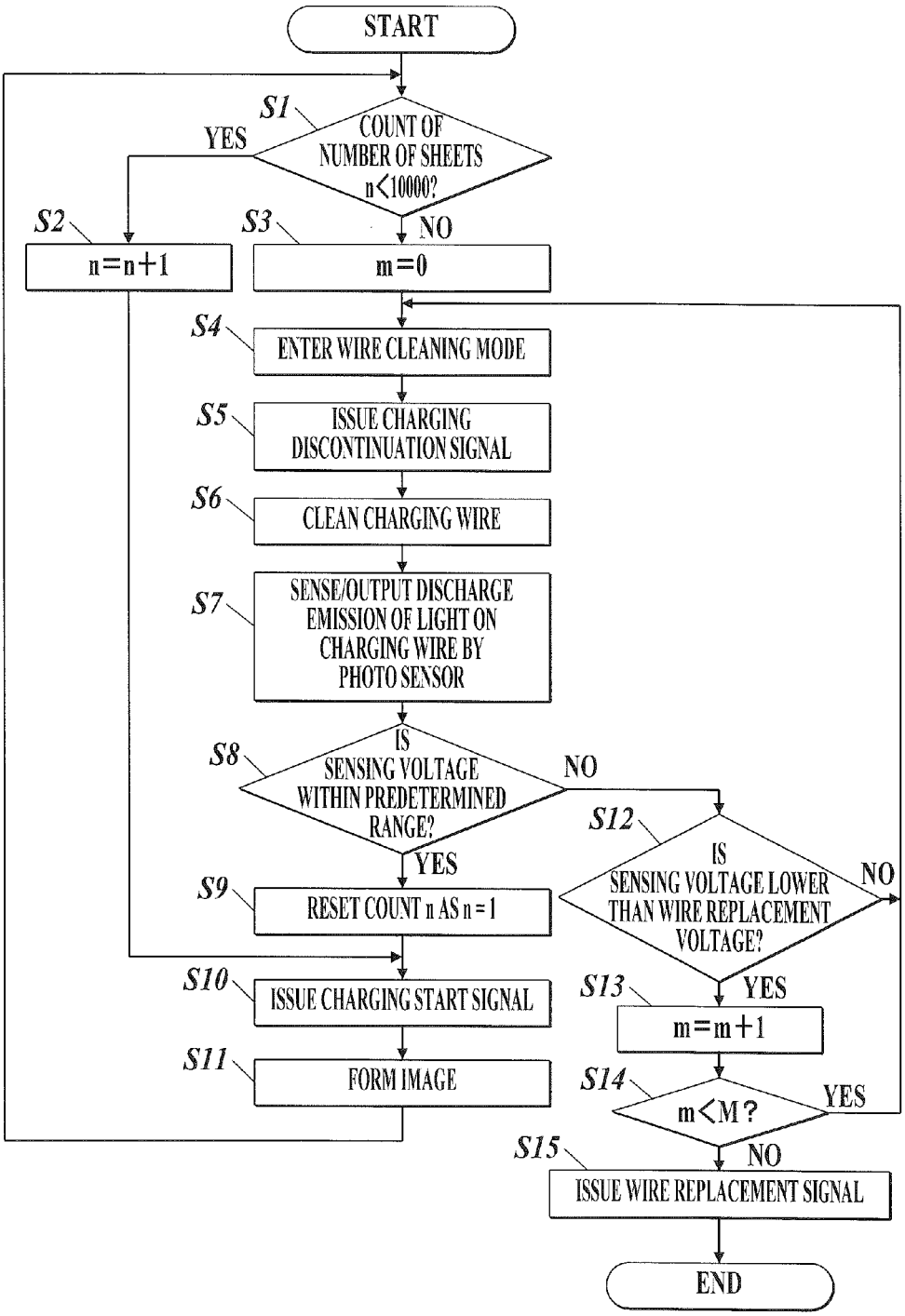
FIG. 5 is a flowchart showing a control procedure in a first embodiment.

Next, a description is made of the control by the CPU 50 in this embodiment. FIG. 5 is a flowchart showing a procedure of the control by the CPU 50. FIG. 5 shows a control procedure in the case of periodically cleaning the charging wire 421 in response to the number of sheets subjected to the image formation.

During execution of the image formation, the CPU 50 is counting the number of sheets subjected to the image formation (Step S1). Then, in the case where a count n of the number of sheets is less than 10000 (Step S1: Yes), the CPU 50 increases the count n of the number of sheets by 1 (Step S2). Then, the CPU 50 starts the charging by the charging wire 421 (Step S10), and continues the image formation (Step S11). When the image formation is completed, the CPU 50 determines one more time whether or not the count of the number of sheets has reached 10000 (Step S1).

In the case where the image formation is performed as described above and the count n of the number of sheets has reached 10000 (Step S1: No), the CPU 50 sets a wire replacement counter m as m=0 (step S3). Then, the CPU 50 enters a charging wire cleaning mode (Step S4), and performs control to discontinue the charging by the charging wire 421 (Step S5).

Next, the CPU 50 allows the execution of the cleaning of the charging wire 421 (Step S6). Specifically, as described by using FIGS. 2A to 2C, the CPU 50 controls the locking mechanisms 428 to turn the cleaning unit 423 to the locked state, and controls the drive unit 429 to move the cleaning unit along the guide rail 423*c*, and thereby cleans the charging wire 421. At this time, the photosensor unit 425 composed integrally with the cleaning unit 423 also moves along the guide rail 423*c*.

When the cleaning of the charging wire 421 is completed, the CPU 50 causes the photosensor unit 425 to sense the discharge emission of light from the charging wire 421 and to output the sensing result (Step S7). Specifically, the CPU 50 controls the locking mechanism 428 to release the locked state of the cleaning unit 423, and allows the voltage source 427 to apply the high voltage for the charging to the charging wire 421, and then allows the drive unit 429 to move the cleaning unit 423 along the guide rail 423*c*. At this time, the photosensor unit 425 also moves integrally with the cleaning unit 423, and accordingly, the discharge emission of light from the charging wire 421 is sensed over the length direction of the charging wire 421 by the photosensor 425*a* in the photosensor unit 425. The sensing result is outputted to the CPU 50. Moreover, the locked state of the cleaning unit 423 is released, and accordingly, the cleaning of the charging wire 421 is not performed.

When the discharge emission of light from the charging wire 421 is sensed and the sensing result is outputted, the CPU 50 performs a variety of controls corresponding to the sensing result of the discharge emission of light. In the case where a sensing voltage of the discharge emission of light is within a predetermined range (Step S8: Yes), the CPU 50 determines that the cleaning of the charging wire 421 is sufficient. Then, the CPU 50 resets the count n of the number of sheets as n=1 (Step S9), and performs control to execute the charging of the photosensitive drum 41 by the charging wire 421 (Step S10). Then, the CPU 50 performs the image formation for subsequent sheets (Step S11).

Meanwhile, in the case where the sensing voltage of the discharge emission of light is out of the predetermined range (Step S8: No), the CPU 50 determines whether or not the sensing voltage concerned is lower than a wire replacement voltage (Step S12). In the case where the sensing voltage is lower than the wire replacement voltage C (Step S12: Yes), the CPU 50 increases the wire replacement counter m by 1 (Step S13). Then, the CPU 50 determines whether or not the wire replacement counter m is less than a predetermined value M (Step S14). In the case where the wire replacement counter m is less than the predetermined value M (Step S14: Yes), the CPU 50 enters the wire cleaning mode (Step S4), and follows the procedure of Step S5 to Step S7. That is to say, the CPU 50 allows the execution of the cleaning of the charging wire 421 one more time, allows the sensing of the discharge emission of light from the charging wire 421, and allows output of a sensing result.

Then, in Step S8, the CPU 50 determines one more time whether or not the sensing voltage of the discharge emission of light is within the predetermined range. In the case where the sensing voltage of the discharge emission of light is out of the predetermined range one more time (Step S8: No), the CPU 50 repeatedly executes the procedure of Step S12 to Step S14. When the wire replacement counter m is less than the predetermined value M in Step S14, the CPU 50 returns to Step S4, where the cleaning of the charging wire 421 is further performed.

When the sensing voltage of the discharge emission of light is settled within the predetermined range in Step S8 (Step S8: Yes), the image formation for the subsequent sheets is performed.

Meanwhile, in the case where the wire replacement counter m has reached the predetermined value M in Step S14 (Step S14: No), that is, in the case where the sensing result of the discharge emission of light falls down M times below the wire replacement voltage C, the CPU 50 issues a wire replacement signal (Step S15). In such a way, for example, the CPU 50 discontinues the execution of the job, and displays contents to advise the replacement of the charging wire 421 on the operation display unit 23.

In such a manner as described above, after the charging wire 421 is periodically cleaned, the charging wire 421 is further cleaned in the case where it is necessary to further clean the charging wire 421 based on the determination for the sensing result of the discharge emission of light. Hence, the image formation is prevented from being executed while the state where the abnormal discharge occurs is being left, and it becomes possible to form a good image free from unevenness.

Moreover, when the sensing result of the discharge emission of light falls down below the wire replacement voltage C the predetermined number of times in the case where the charging wire 421 is periodically cleaned, the CPU 50 notifies the user that it is a time to replace the charging wire 421. In such a way, the user can easily get to know the time to replace the charging wire 421.

The discharge emission of light for actually charging the photosensitive drum 41 is sensed, and the above-described control is performed based on the sensing result thereof. Hence, in comparison with the conventional technology, it becomes possible to more surely prevent the charging by the abnormal discharge, and to get to know the time to replace the charging wire 421.

Moreover, the cleaning unit 423 and the photosensor unit 425 are composed integrally with each other, whereby cost reduction is achieved.

In this embodiment, in Step S8 of FIG. 5, it is determined whether or not the sensing voltage of the discharge emission of light is within the predetermined range. However, as described by using FIG. 3B, it may be determined whether or not the difference h−l between the maximum value and minimum value of the sensing voltage has become larger than a predetermined value. Moreover, as described by using FIG. 3C, it may be determined whether or not there has been a voltage variation with the predetermined range R or more during the short period Δt.

Moreover, in this embodiment, the notice to indicate that it is a time to replace the charging wire 421 is issued in the case where the sensing result of the discharge emission of light falls down below the wire replacement voltage C the predetermined number of times. However, this predetermined number of times can be set as appropriate, and may be once or a plurality of times.

Subsequently, a description is made of a second embodiment of the present invention. In comparison with the first embodiment, this embodiment is different therefrom in control procedure by the CPU 50, and except for this, has a similar configuration to that of the first embodiment. Hence, with regard to portions which duplicate the above-mentioned portions, a detailed description thereof is omitted.

Figure 6:
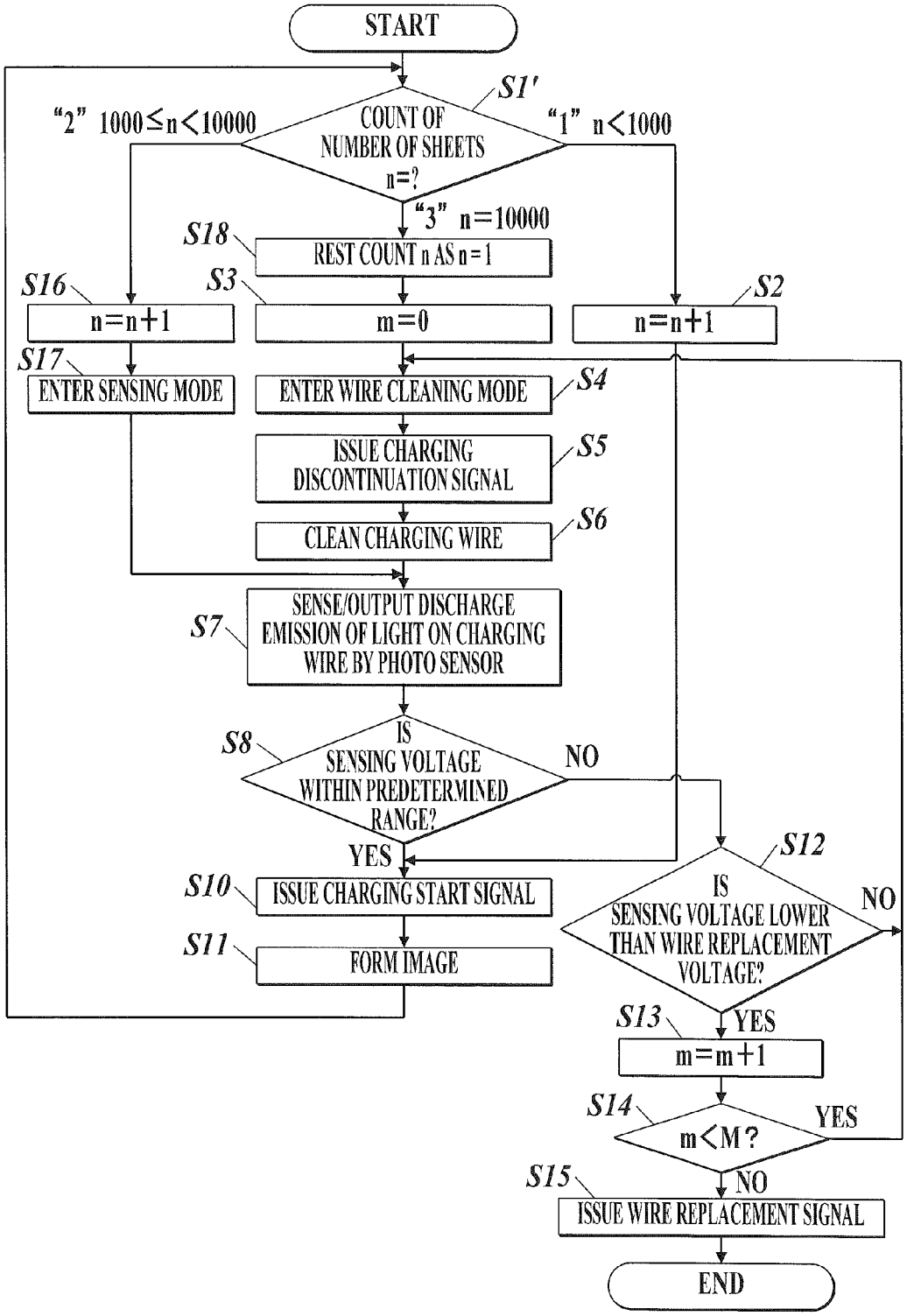
FIG. 6 is a flowchart showing a control procedure in a second embodiment.

FIG. 6 is a flowchart showing a control procedure by the CPU 50 in this embodiment. FIG. 6 shows a control procedure in the case of sensing the discharge emission of light for each image formation for one sheet after the image formation is performed for a predetermined number of sheets after the charging wire 412 is periodically cleaned, this sensing being performed in addition to the cleaning concerned. In FIG. 6, the same reference symbols are assigned to similar steps to the respective steps shown in FIG. 5.

In the flowchart shown in FIG. 6, a thing different from that in the procedure shown in FIG. 5 is that, in the case where the count n of the number of sheets is 1000 or more to less than 10000 in Step S1' (Step S1': "2"), the CPU 50 performs control to increase the counter n of the number of sheets by 1 (Step S16) and to enter such a sensing mode (Step S17).

Upon entering the sensing mode, the CPU 50 proceeds to Step S7, and senses the discharge emission of light from the charging wire 421. Specifically, the CPU 50 releases the locked state of the cleaning unit 423, and applies a voltage to the charging wire 421. Then, the CPU 50 moves the cleaning unit 423 and the photosensor unit 425, which are composed integrally with each other, along the guide rail 423*c*.

Here, in the control procedure shown in FIG. 5, a step of cleaning the charging wire 421 is present without fail before the step of sensing the discharge emission of light from the charging wire 421. Therefore, in the event of cleaning the charging wire 421, the cleaning unit 423 is turned to the locked state, and is moved from the point A of FIG. 2B to the point B thereof, and in the event of sensing the discharge emission of light, the locked state of the cleaning unit 423 is released, and is moved from the position B of FIG. 2B to the position A thereof. However, in Step S7 of FIG. 6, the step of cleaning the charging wire 421 is not always present before Step S7 concerned. Hence, in the event of sensing the discharge emission of light, it is sometimes possible that the discharge emission of light concerned may be sensed after the cleaning unit 423 is moved from the point A of FIG. 2B to the point B thereof.

When the discharge emission of light from the charging wire 421 is sensed and the sensing result is outputted in Step S7, the CPU 50 performs a variety of controls corresponding to the sensing result of the discharge emission of light (Step S8). In the case where the sensing voltage of the discharge emission of light is within the predetermined range (Step S8: Yes), the CPU 50 performs control to execute the charging of the photosensitive drum 41 by the charging wire 421 (Step S10). Then, the CPU 50 performs the image formation for subsequent sheets (Step S11).

Meanwhile, in the case where the sensing voltage of the discharge emission of light is out of the predetermined range (Step S8: No), the CPU 50 executes the procedure of Step S12 to Step S14. That is to say, the CPU 50 determines whether or not the sensing voltage concerned is lower than the wire replacement voltage, and increases the wire replacement counter m by 1 in the case where the sensing voltage is lower than the wire replacement voltage C. Then, the CPU 50 determines whether or not the wire replacement counter m is less than the predetermined value M. In the case where the wire replacement counter m has reached the predetermined value M (Step S14: No), the CPU 50 issues the wire replacement signal (Step S15).

In the case where the wire replacement counter m has not reached the predetermined value M (Step S14: Yes), the CPU 50 proceeds to the procedure of Step S4 to Step S8. That is to say, the CPU 50 allows the execution of the cleaning of the charging wire 421, and allows the sensing of the discharge emission of light after the completion of the cleaning. When the outputted sensing voltage of the discharge emission of light is settled within the predetermined range (Step S8: Yes), the CPU 50 starts the charging by the charging wire 421 (Step S10), proceeds to the image formation for the subsequent sheets (Step S11).

As described above, in the case where the number of sheets subjected to the image formation is 1000 or more to less than 10000, the discharge emission of light from the charging wire 421 is sensed for each image formation for one sheet, and the cleaning of the charging wire 421 is executed in the case where the abnormal discharge is sensed.

In the case where the count n of the number of sheets has reached 10000 in Step S1' (Step S1': "3"), the CPU 50 resets the count n of the number of sheets as n=1 (Step S18). Then, the CPU 50 sets the wire replacement counter m as m=0 (Step S3), and executes the procedure of Step S4 to Step S8. That is to say, the CPU 50 allows the execution of the cleaning of the charging wire 421, and allows the sensing of the discharge emission of light after the completion of the cleaning.

When the sensing voltage of the discharge emission of light is settled within the predetermined range (Step S8: Yes), the CPU 50 performs control to execute the charging of the photosensitive drum 41 by the charging wire 421 (Step S10). Then, the CPU 50 performs the image formation for subsequent sheets (Step S11). When the sensing voltage of the discharge emission of light is out of the predetermined range (Step S8: No), the CPU 50 allows the execution of the procedure of Step S12 to Step S14 one more time. If the wire replacement counter m increased by 1 has not reached the predetermined value M (Step S14): Yes), then the CPU 50 proceeds to the procedure of Step S4 to Step S8. That is to say, the CPU 50 allows the cleaning of the charging wire 421 and the sensing of the discharge emission of light one more time.

As described above, the CPU 50 allows the execution of the cleaning of the charging wire 421 until the sensing result of the discharge emission of light is settled within the predetermined range.

In accordance with this control procedure, in the case where the number of sheets subjected to the image formation has reached 10000, the cleaning of the charging wire 421 is performed, and the count of the number of sheets is reset. That is to say, the cleaning of the charging wire 421 is periodically performed for each image formation for 10000 sheets. In accordance with the control procedure of FIG. 6, even if the cleaning is performed when the number of sheets is 1000 or more to less than 10000, such periodical cleaning is performed without fail when the number of sheets has reached 10000 from the previous periodical cleaning. However, such a control procedure may be adopted, in which, in the case where the cleaning is performed once, the count of the number of sheets is reset at that point of time. In such a way, it is also possible to adopt a configuration in which the above-described periodical cleaning is performed only in the case where the cleaning is never performed during a period from when the cleaning is performed no matter whether or not the cleaning concerned may by periodical until when the number of sheets has reached 10000. In order to execute such control as described above, the procedure of Step S18 of FIG. 6 just needs to be provided between Step S8 and Step S10.

Moreover, in the case where the count n of the number of sheets has not reached 1000 in Step S1 (Step S1': "1"), the CPU 50 increases the count n of the number of sheets by 1 (Step S2), and proceeds to the image formation for the subsequent sheets without allowing the sensing of the discharge emission of light. This procedure is based on a thought that a possibility that the charging wire 421 may get dirty and the abnormal discharge may occur is small during a period while the image formation is not performed much. By this control procedure, it is possible to enhance the productivity during this period. However, the sensing of the discharge emission of light may be executed for each image formation of one sheet even in the case where the number of sheets subjected to the image formation has not reached 1000.

In accordance with this embodiment, the discharge emission of light is sensed for each image formation of one sheet, the sensing result thereof is outputted to the CPU 50, and the CPU 50 controls the operations of the cleaning unit 423 based on the sensing result. Hence, even in the case where the charging wire 421 gets dirty suddenly and the abnormal discharge occurs, the charging wire 421 can be cleaned soon by the cleaning unit 423. In such a way, it becomes possible to prevent the occurrence of the image unevenness caused by a sudden abnormal discharge.

Moreover, it is determined whether or not it is a time to replace the charging wire 421 for each image formation of one sheet, and accordingly, the user can be notified soon that the current state is a state where the charging wire 421 should be replaced when the state concerned occurs. Hence, it becomes possible to more surely prevent an image failure and the like, which are caused by the fact the charging wire 421 is used while the state where the charging wire 421 should be replaced is being left.

Furthermore, the discharge emission of light for actually charging the photosensitive drum 41 is sensed, and the above-described control is performed based on the sensing result thereof. Accordingly, it becomes possible to surely prevent the charging by the abnormal discharge, and to issue a notice on the time to replace the charging wire 421.

Subsequently, a description is made of a third embodiment of the present invention. A detailed description of configurations in this embodiment, which duplicate those in the first or second embodiment, is omitted.

Figure 7:
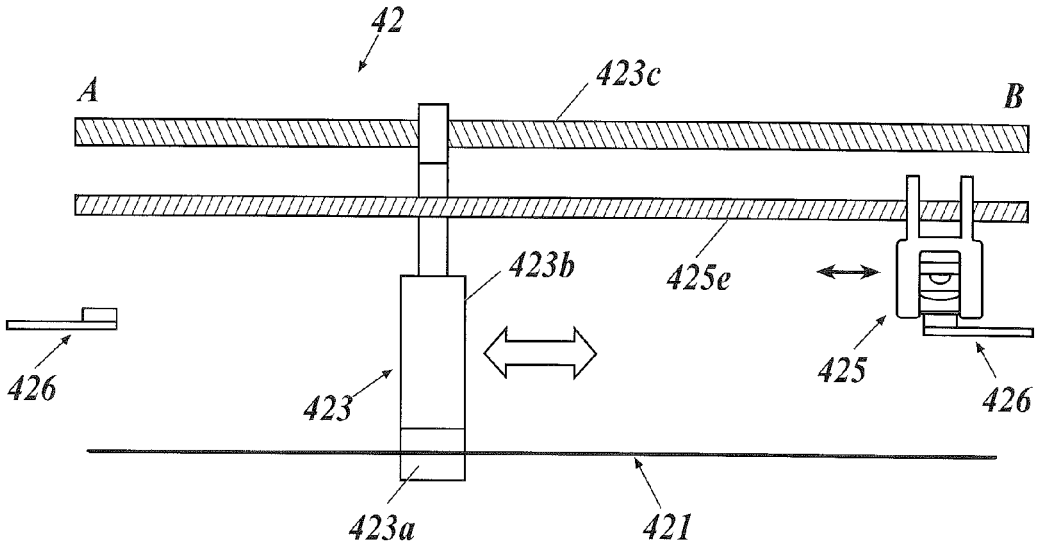
FIG. 7 is a view showing a configuration of a charging unit in a third embodiment.

FIG. 7 is a view showing a configuration of a charging unit 42 in this embodiment. In this embodiment, the cleaning unit 423 and the photosensor unit 425 are driven independently of each other. As shown in FIG. 7, the cleaning unit 423 is moved along the guide rail 423*c* by a drive unit (not shown), and the photosensor unit 425 is moved along a guide rail 425*e* by another drive unit (not shown).

With regard to a control procedure by a CPU 50 in this embodiment, a similar procedure to the procedure shown in FIG. 5 or FIG. 6 can be applied, and accordingly, a detailed description thereof is omitted.

In this embodiment, the cleaning unit 423 and the photosensor unit 425 are driven independently of each other. Hence, when it is timing to sense the discharge emission of light, the photosensor unit 425 can be moved instantaneously, and accordingly, it becomes possible to perform the sensing of the discharge emission of light smoothly.

Subsequently, a description is made of a fourth embodiment of the present invention. A detailed description of configurations in this embodiment, which duplicate the above-mentioned configurations, is omitted.

Figure 8:
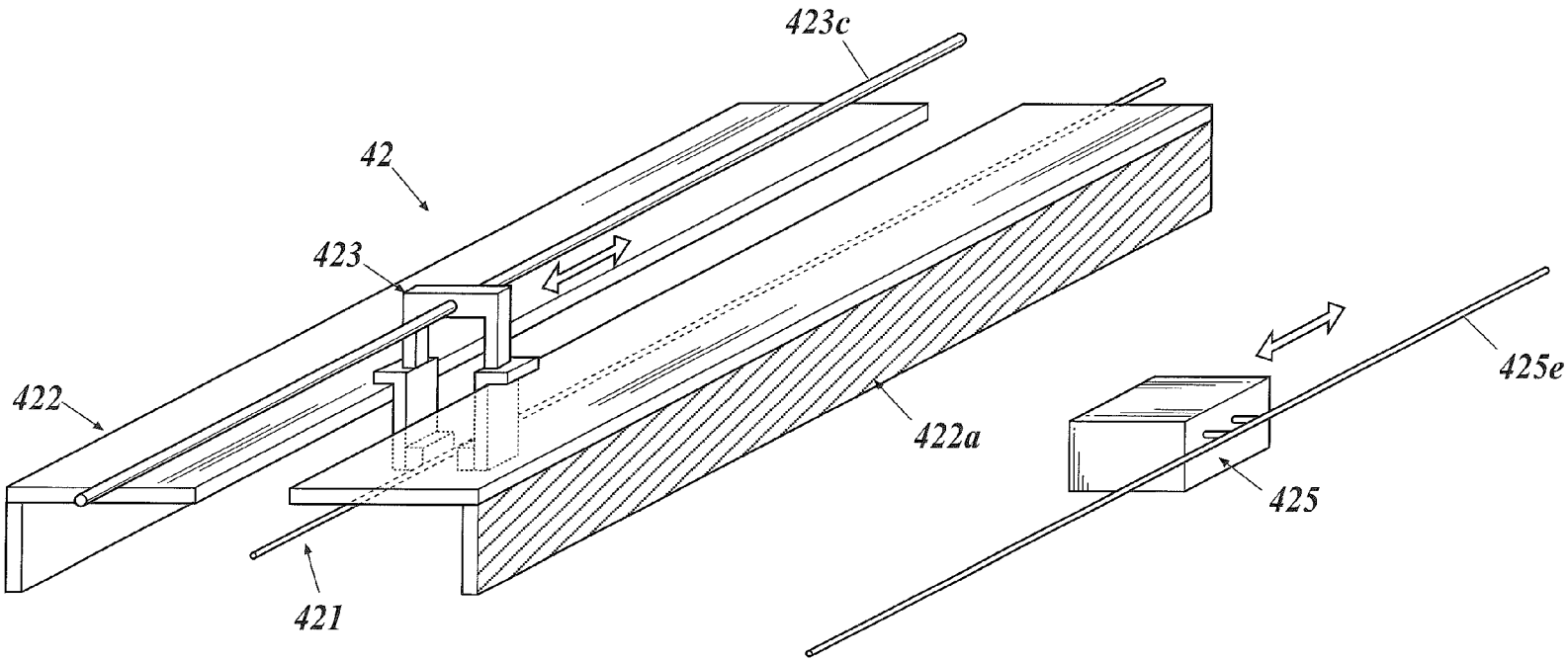
FIG. 8 is a view showing a configuration of a charging unit in a fourth embodiment.

FIG. 8 is a view showing a configuration of a charging unit 42 in this embodiment. In this embodiment, the cleaning unit 423 and the photosensor unit 425 are driven independently of each other. Moreover, the photosensor unit 425 and the guide rail 425*e* are provided on an outside of a side surface of the stabilizer 422. Furthermore, a stabilizer 422*a* on the side on which the photosensor unit 425 is provided is composed of an optically transparent substance.

In the case of sensing the discharge emission of light, which comes from the charging wire 421, with the configuration as described above, the photosensor unit 425 is moved along the guide rail 425*e* by a drive unit (not shown). The photosensor 425*a* senses the discharge emission of light, which comes from the charging wire 421, and transmits through the stabilizer 422*a* composed of the optically transparent substance.

As the stabilizer 422*a*, for example, one in which ITO is coated on a surface of a glass substrate can be used. Besides this, materials which have conductivity and optical transparency can be used.

With regard to a control procedure by a CPU 50 in this embodiment, a similar procedure to the procedure shown in FIG. 5 or FIG. 6 can be applied, and accordingly, a detailed description thereof is omitted.

In this embodiment, the cleaning unit 423 and the photosensor unit 425 are driven independently of each other. Hence, when it is timing to sense the discharge emission of light, the photosensor unit 425 can be moved instantaneously, and accordingly, it becomes possible to perform the sensing of the discharge emission of light smoothly.

Moreover, the photosensor unit 425 is provided apart by the stabilizer 422*a*, and accordingly, the light condensing lens 425*b* is hardly affected by the discharge and the toner dirt. Hence, the protection plate 425*c* is not provided in this embodiment. In such a way, it becomes possible to reduce the cost.

Figure 9:
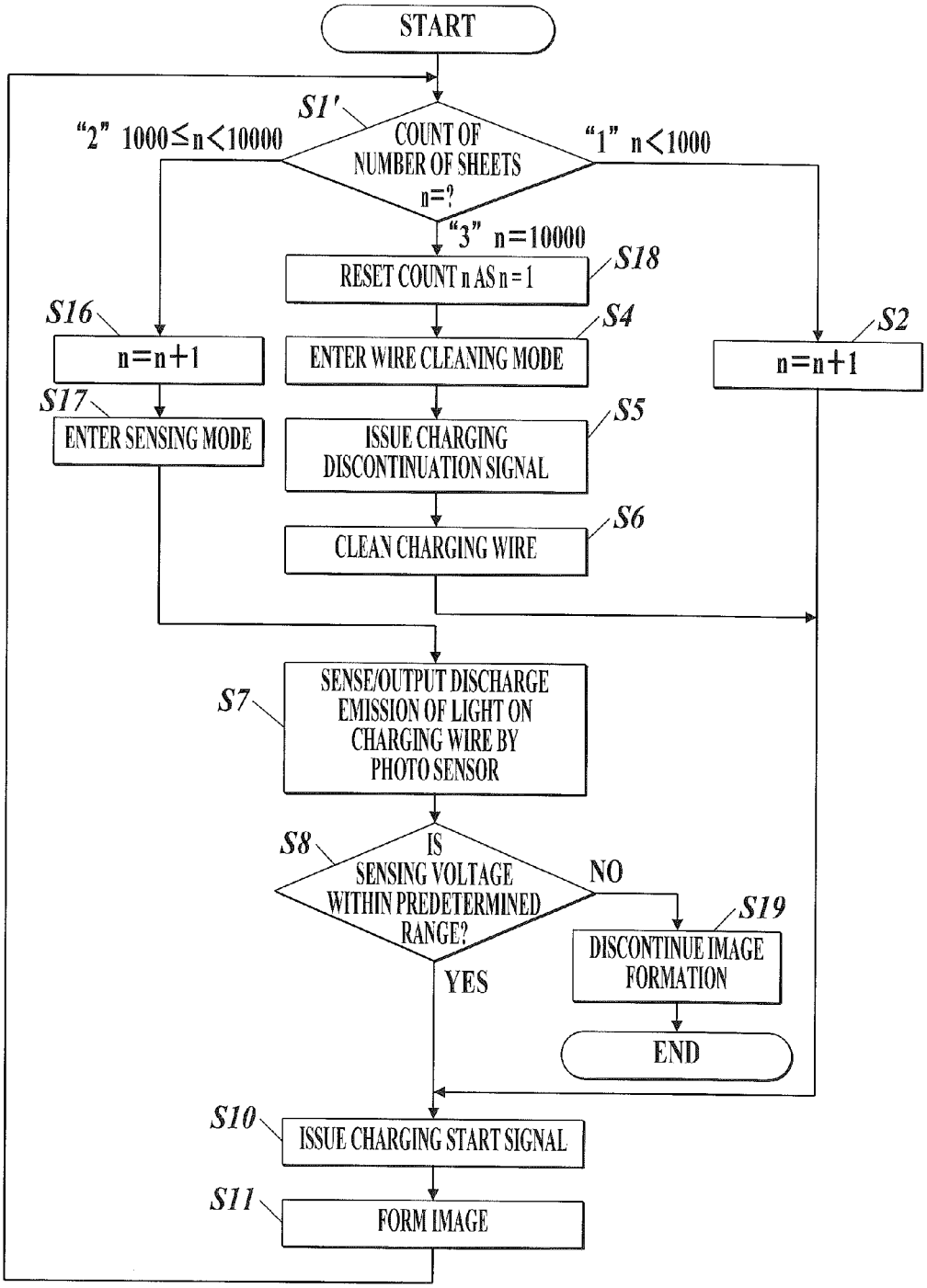
FIG. 9 is a flowchart showing a control procedure in a fifth embodiment.

Subsequently, a description is made of a fifth embodiment of the present invention. FIG. 9 is a flowchart showing a control procedure by a CPU 50 in this embodiment. A detailed description of configurations in this embodiment, which duplicate the above-mentioned configurations, is omitted. In FIG. 9, the same reference symbols are assigned to similar steps to the respective steps mentioned above.

Moreover, as a charging unit 42 in this embodiment, the configuration shown in any of FIGS. 2A to 2C, FIG. 7 and FIG. 8 may be used.

In this embodiment, in the case where the sensing result of the discharge emission of light is not within the predetermined range, the CPU 50 performs control to forcibly discontinue the image formation.

In the flowchart shown in FIG. 9, in the case where the outputted sensing result of the discharge emission of light is not within the predetermined range (range between H and L, which are shown in FIGS. 3A to 3C) in Step S8 (Step S8: No), the CPU 50 discontinues the image formation (Step S19).

In such a way, it becomes possible to prevent the occurrence of the image unevenness caused by the charging of the photosensitive drum 41 owing to the abnormal discharge. The discharge emission of light for actually charging the photosensitive drum 41 is sensed, and accordingly, it becomes possible to more surely prevent the charging by the abnormal discharge.

In the flowchart shown in FIG. 9, when the count n of the number of sheets has reached 10000 (n=10000) in Step S1' (Step S1': "3"), the CPU 50 resets the count n of the number of sheets as n=1 (Step S18). Then, through the procedure of Step S4 to Step S6, the CPU 50 allows the execution of the cleaning of the charging wire 421. When the cleaning of the charging wire 421 is performed, the CPU 50 issues a charging start signal (Step S10), and performs the subsequent image formation (Step S11).

However, as shown in FIG. 5 and FIG. 6, after the cleaning of the charging wire 421 is executed in Step S6, the CPU 50 may proceed to Step S7, and may allow the sensing of the discharge emission of light. Moreover, in the case where the sensing voltage is not within the predetermined range in Step S8 (Step S8: No), it is not necessary to immediately discontinue the image formation. For example, in the case where the charging wire 421 is cleaned one more time and the sensing voltage is not within the predetermined range again, the image formation may be configured to be discontinued.

Figure 10:
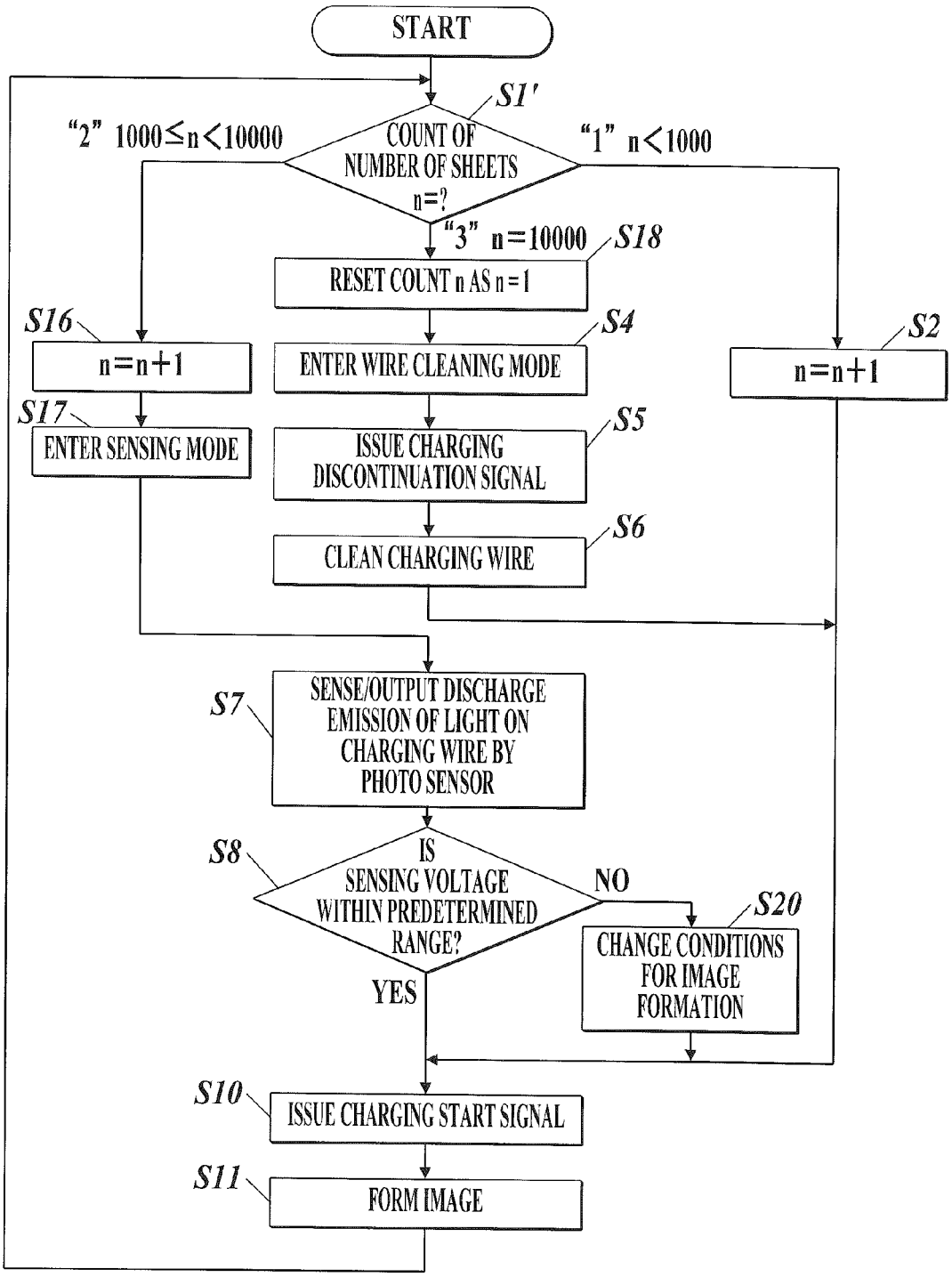
FIG. 10 is a flowchart showing a control procedure in a sixth embodiment.

Subsequently, a description is made of a sixth embodiment of the present invention. FIG. 10 is a flowchart showing a control procedure by a CPU 50 in this embodiment. A detailed description of configurations in this embodiment, which duplicate the above-mentioned configurations, is omitted. In FIG. 10, the same reference symbols are assigned to similar steps to the respective steps mentioned above.

Moreover, as a charging unit 42 in this embodiment, the configuration shown in any of FIGS. 2A to 2C, FIG. 7 and FIG. 8 may be used.

In this embodiment, in the case where the sensing result of the discharge emission of light is not within the predetermined range, the CPU 50 performs control to change operation conditions and the like related to the image formation.

In the flowchart shown in FIG. 10, in the case where the outputted sensing result of the discharge emission of light is not within the predetermined range (range between H and L, which are shown in FIGS. 3A to 3B) in Step S8 (Step S8: No), the CPU 50 changes the operation conditions related to the image formation (Step S20).

As the conditions to be changed in Step S20, an exposure amount, a developing bias and the like are mentioned. For example, in the case where a sensing result that a spot with a small charging amount occurs on the photosensitive drum 41 is obtained in Step S8, then an exposure condition is changed so as to reduce an exposure amount on the spot concerned, or alternatively, a developing condition is changed so as to increase a developing bias on the spot concerned. Moreover, besides the above-described conditions, such image processing as compensating charging unevenness may be implemented for image data.

In such a way, it becomes possible to prevent the occurrence of the image unevenness caused by the charging of the photosensitive drum 41 owing to the abnormal discharge. The discharge emission of light for actually charging the photosensitive drum 41 is sensed, and accordingly, it becomes possible to more surely prevent the charging by the abnormal discharge.

Though the description is also made in the fifth embodiment, after the cleaning of the charging wire 421 is executed in Step S6, the CPU 50 may proceed to Step S7, and may allow the sensing of the discharge emission of light, and may allow the output of the sensing result.

Figure 11:
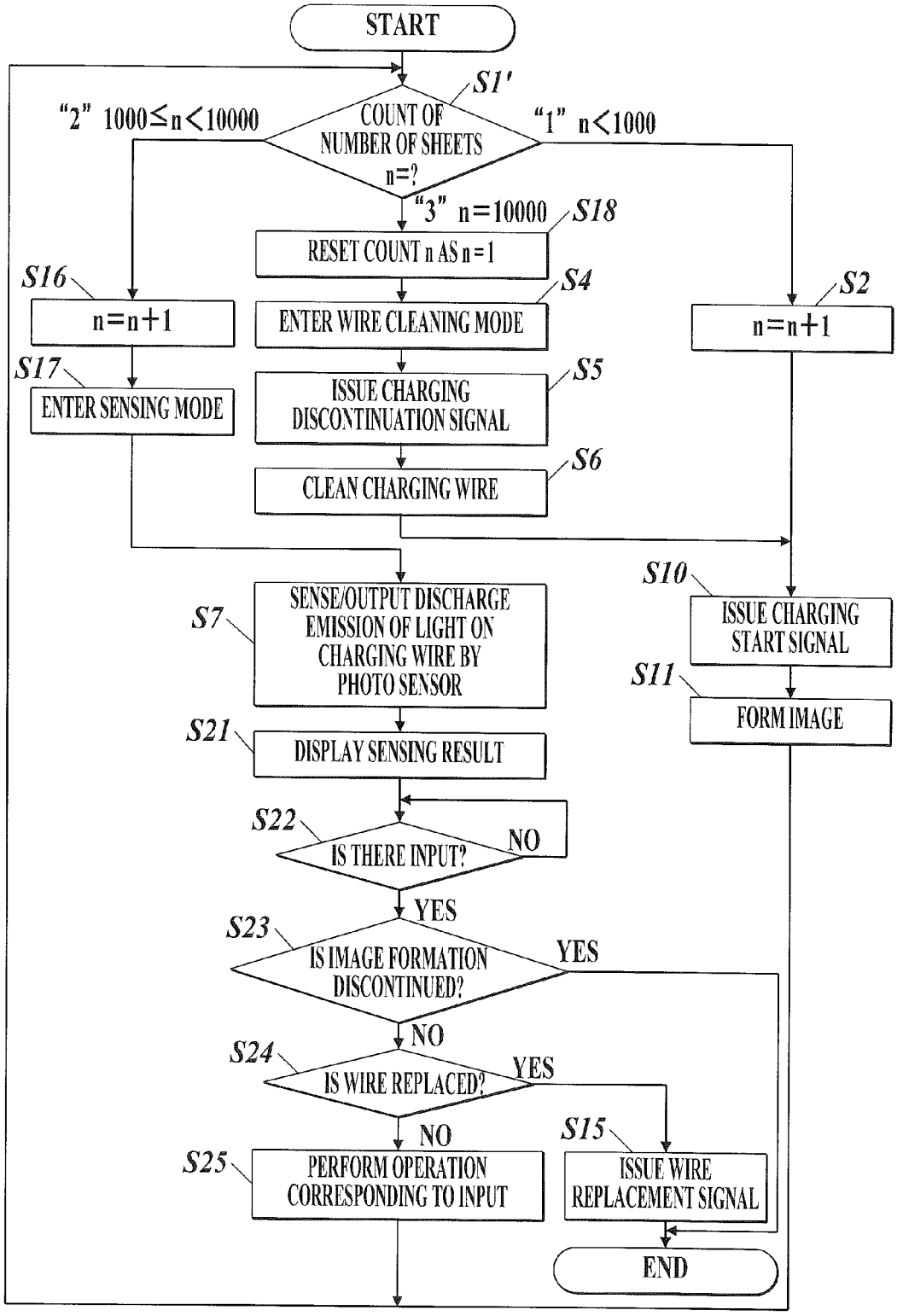
FIG. 11 is a flowchart showing a control procedure in a seventh embodiment.

Subsequently, a description is made of a seventh embodiment of the present invention. FIG. 11 is a flowchart showing a control procedure by a CPU 50 in this embodiment. A detailed description of configurations in this embodiment, which duplicate the above-mentioned configurations, is omitted. In FIG. 11, the same reference symbols are assigned to similar steps to the respective steps mentioned above.

Moreover, as a charging unit 42 in this embodiment, the configuration shown in any of FIGS. 2A to 2C, FIG. 7 and FIG. 8 may be used.

This embodiment is characterized in that the sensing result of the discharge emission of light is displayed on the operation display unit 23 and the like, and the user is allowed to decide the next operation.

In the flowchart shown in FIG. 11, upon sensing the discharge emission of light, which comes from the charging wire 421 (Step S7), the CPU 50 allows the operation display unit 23 to display the sensing result (Step S21). At this time, the CPU 50 may allow the operation display unit 23 to display the graphs shown in FIGS. 3A to 3C, or to perform such display as explaining the sensing result, or to display only information as to whether or not the sensing voltage is settled within the predetermined range. Moreover, the CPU 50 allows the operation display unit 23 to display options for operations, which come next, simultaneously with the sensing result.

Then, the CPU 50 receives input by the user (Step S22). When the input from the user is made after waiting for the input concerned (Step S22: Yes), the CPU 50 determines whether or not the input instructs the discontinuation of the image formation (Step S23). In the case where the input by the user instructs the discontinuation of the image formation (Step S23: Yes), the CPU 50 ends the processing.

Meanwhile, in the case where the input by the user does not instruct the discontinuation of the image formation (Step S23: No), the CPU 50 subsequently determines whether or not the input by the user instructs the replacement of the charging wire 421 (Step S24). In the case where the input by the user instructs the replacement of the charging wire 421 (Step S24: Yes), the CPU 50 issues the wire replacement signal (Step S15), and ends the processing.

In the case where the input by the user does not instruct the replacement of the charging wire 421 (Step S24: No), the CPU 50 allows operations according to the input by the user (Step S25). As the operations according to the input by the user, for example, there are mentioned: the continuation of the image formation without adding anything; the continuation of the image formation after cleaning the charging wire 421; another display of the sensing result after cleaning the charging wire 421; and the like.

In such a way, it becomes possible to prevent the occurrence of the image unevenness caused by the charging of the photosensitive drum 41 owing to the abnormal discharge. The discharge emission of light for actually charging the photosensitive drum 41 is sensed, and accordingly, it becomes possible to more surely prevent the charging by the abnormal discharge. Moreover, there is an advantage that it is easy for the user to grasp the sensing result of the discharge emission of light and it is possible to execute the operations desired by the user.

Though the description is also made in the fifth embodiment, after the cleaning of the charging wire 421 is executed in Step S6, the CPU 50 may proceed to Step S7, and may allow the sensing of the discharge emission of light, and may allow the output of the sensing result.

Moreover, though the sensing result of the discharge emission of light is displayed on the operation display unit 23 and the like in this embodiment, it is not necessarily necessary to display the sensing result on the operation display unit 23. A notice on the sensing result may be configured to be issued by other methods such as voice notification, or only options for the sensing result may be configured to be displayed without issuing the notice concerned.

Although the present invention has been fully described byway of examples with reference to the accompanying drawings, it is to be noted that various changes and modifications will be apparent to those skilled in the art. Therefore, unless otherwise such changes and modifications depart from the scope of the present invention, they should be constructed as being included therein.

What is claimed is:

1. A charging device comprising:

a charging member to charge an object;

an applying unit to apply a voltage to the charging member for generating an electric discharge from the charging member, so that the object is discharged by the charging member;

a detecting unit to detect an emission of light of the electric discharge;

an output unit to output a detection result by the detecting unit;

a cleaning unit to clean the charging member;

a controller to control the cleaning unit to clean the charging member when the detection result is out of a predetermined range; and a board provided disposed so as to surround the charging member and having an opening opposite to the object;

wherein the detecting unit and the cleaning unit is moved independently of each other;

wherein the detecting unit is disposed at opposite side to the board across the charging member; and wherein a portion of the board opposite to the detecting unit is formed with a material having electrical conductivity and light permeability.

2. An image forming apparatus comprising:

an image carrier;

the charging device of claim 1 to charge the image carrier;

an exposure unit to expose the image carrier charged by the charging device and form an electrostatic latent image;

a developing unit to form a toner image by providing a toner with the electrostatic latent image formed by the exposure unit;

a transferring unit to transfer the toner image formed by the developing unit to a recording sheet;

a fixing unit to fix the toner image transferred by the transferring unit onto the recording sheet; and an image processor to process image data;

wherein the image processor processes the image data so as to cancel a fluctuation of the detection result.

3. An image forming apparatus comprising:

an image carrier;

the charging device of claim 1 to charge the image carrier;

an exposure unit to expose the image carrier charged by the charging device and form an electrostatic latent image;

a developing unit to form a toner image by providing a toner with the electrostatic latent image formed by the exposure unit;

a transferring unit to transfer the toner image formed by the developing unit to a recording sheet; and a fixing unit to fix the toner image transferred by the transferring unit onto the recording sheet;

wherein the detecting unit detects the emission of light at every image forming operation onto one recording sheet, and wherein the output unit outputs the detection result every time when the detecting unit detects the emission of light.

* * * * *